US005988915A

United States Patent [19]

Magill

[11] Patent Number: 5,988,915

[45] Date of Patent: Nov. 23, 1999

[54] NOVELTY PENCIL

[75] Inventor: William James Dermott Magill, Tadley, United Kingdom

[73] Assignee: Vogue Housewares Limited, Berkshire, United Kingdom

[21] Appl. No.: 09/193,017

[22] Filed: Nov. 16, 1998

[51] Int. Cl.[6] ..... B43K 25/00

[52] U.S. Cl. ..... 401/52; 401/195

[58] Field of Search ..... 401/52, 195, 6, 401/49, 48

[56] References Cited

U.S. PATENT DOCUMENTS

| | | | |
|---|---|---|---|
| 1,711,383 | 4/1929 | Goodridge | 401/52 |
| 1,974,667 | 9/1934 | Solinger | 401/52 |
| 2,248,145 | 7/1941 | Wider | 401/52 |
| 2,396,405 | 3/1946 | Adams | 401/52 |
| 3,615,596 | 10/1971 | Petti | 401/52 |
| 3,961,852 | 6/1976 | Parry | 401/52 |

FOREIGN PATENT DOCUMENTS

| | | |
|---|---|---|
| 0823234 | 2/1998 | European Pat. Off. . |
| 1362764 | 8/1974 | United Kingdom . |
| 2219255 | 12/1989 | United Kingdom . |

*Primary Examiner*—David J. Walczak
*Attorney, Agent, or Firm*—Edwin D. Schindler

[57] ABSTRACT

A novelty pencil comprises a novelty device 11 and an elongate wooden body 10 formed by a convention pencil. The body 10 of the novelty pencil has a reduced diameter portion 20 at one end, which is inserted into a tubular plastics portion 14 of the novelty device 11. A plastics model 17 of the novelty device 11 is adhered to an external surface of the tubular plastics portion 14 of the device. Accordingly, the three separate parts 10,14,17 of the novelty pencil are securely fastened together.

7 Claims, 1 Drawing Sheet

NOVELTY PENCIL

BACKGROUND OF THE INVENTION

1. Field of the Invention

This invention relates to a novelty pencil.

2. Related Background Art

It is well known to attach figurines or other models to conventional wooden pencils, so that they can be sold as souvenirs at tourist attractions etc.

In one known arrangement, the upper end of the pencil is merely inserted into an aperture formed in the model. However, a disadvantage of this arrangement is that the location and depth of the aperture severely limits the shape and configuration of the model.

In another known arrangement, the figurine is adhered to the side of the pencil. However, a disadvantage of this arrangement is that the pencils to which the models are attached are normally coated with paint, which can break away from the pencil when a moderate force is applied to the model.

We have now devised a novelty pencil which alleviates the above-mentioned problems.

SUMMARY OF THE INVENTION

In accordance with the invention there is provided a novelty pencil comprising a novelty device and an elongate wooden body which encloses a core of graphite or other material, the body being inserted into a tubular plastics portion of the novelty device, the novelty device further comprising a plastics model adhered to an external surface of the tubular plastics portion.

The plastics model will not become detached because it is adhered to the plastics tube: it will be appreciated that strong bonds can be formed between two plastics objects. The novelty device is mechanically engaged with the body of the pencil and thus will not readily become detached.

Preferably the tubular portion of the novelty device is fitted, preferably as an interference fit, to an upper end of the body which is reduced in diameter. Preferably the external cross-sectional shape and size of the tubular portion of the novelty device corresponds with the external cross-sectional shape and size of the body.

Preferably the tubular portion of the novelty device is adhered to the reduced diameter portion of the portion of the body.

Preferably the tubular portion of the novelty device is open at one end, its opposite end comprising an enlargement on which text or other decorative matter can be provided.

Preferably the enlargement comprises a pair of faces which face in opposite directions radially of the pencil.

BRIEF DESCRIPTION OF THE DRAWINGS

An embodiment of this invention will now be described by way of example only and with reference to the accompanying drawings, in which.

DETAILED DESCRIPTION OF THE PREFERRED EMBODIMENTS

Figure 1:
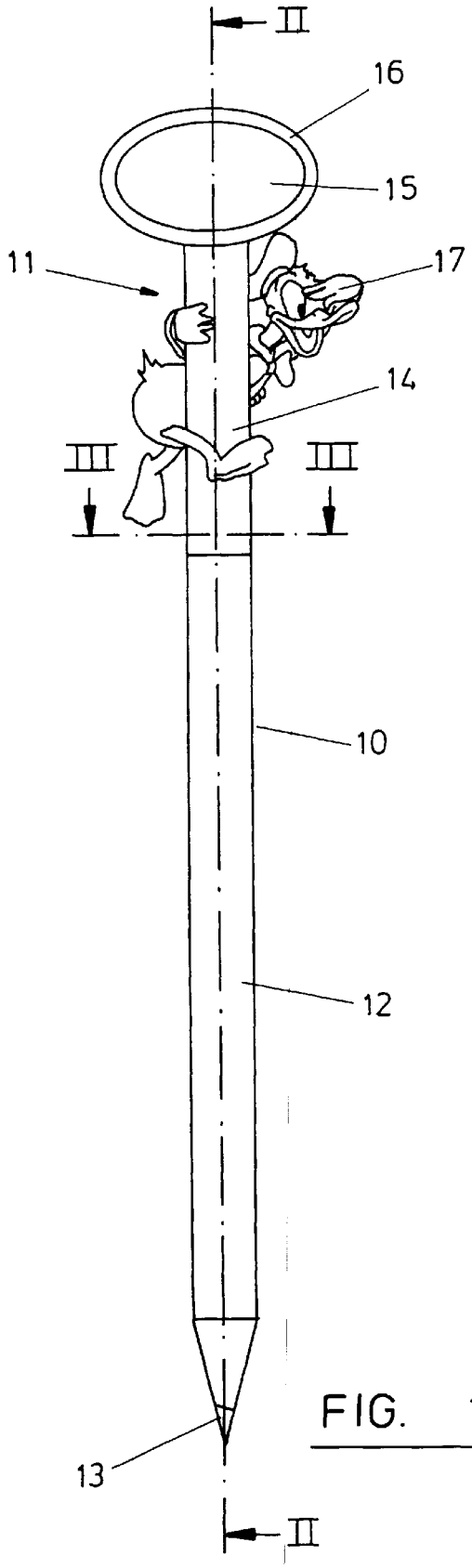
FIG. 1 is a side view of an embodiment of novelty pencil in accordance with this invention.
Figure 2:
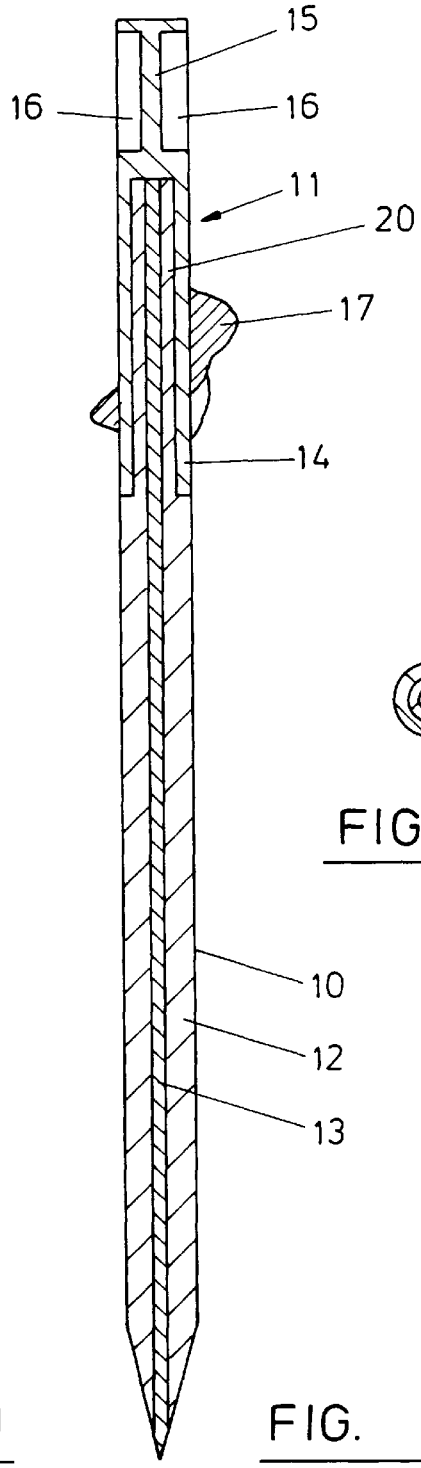
FIG. 2 is a sectional view along the line II—II of FIG. 1.
Figure 3:
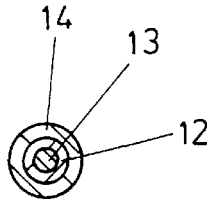
FIG. 3 is a sectional view along the line III—III of FIG. 1.

Referring to the drawings, there is shown a novelty pencil comprising a conventional pencil 10 and a plastics novelty device 11 attached to the upper end of the pencil 10.

The pencil comprises an elongate circular-section wooden body 12 which encloses a graphite core 13 or so-called lead. The lower end of the pencil 10 is sharpened to a point thereby exposing the lead 13.

The outer portion of the wooden body 12 is removed over 50 mm or so at the upper end of the pencil in order to form a region 20 having a reduced wall diameter.

The novelty device 11 comprises a plastics tube 14 having an internal diameter which is slightly greater than the external diameter of the region 20 at the top of the pencil 10. The external diameter of the plastics tube 14 is substantially equal to the external diameter of the normal portion of the pencil 10, the length of the tube 14 being slightly greater than the length of the reduced diameter region 20 at the top of the pencil 10.

The upper end of the tube 14 is closed and an oval extension 15 extends axially from the upper end of the tube 14. The extension 15 comprises opposite flat faces, which face in opposite directions radially of the pencil 10, and a peripheral wall 16 which forms a decorative border around each of the opposite flat faces of the extension 15. Writing or other decorative material may be formed on one or each face of the extension 15.

A plastics figurine 17 is adhered to the plastics tube 14. The figurine 17 is preferably in a pose which appears as if the figurine is clutching the tube 14, although this is not essential.

The plastics tube 14 is adhered to the reduced diameter region 20 at the top of the pencil 10, in order to permanently secure the novelty device 11 to the pencil 10.

The plastics figurine 17 will not become detached because it is adhered to the plastics tube 14 and it will be appreciated that a strong bond can be formed between two plastics pieces. The novelty device 11 is both mechanically engaged with and adhered to the pencil 10 and thus will not become detached therefrom. The pencil may be coated with paint, although its reduced diameter region is preferably free from paint so that a strong bond is formed between the wood of the body 12 and the plastics tube 14.

I claim:

1. A novelty pencil comprising a novelty device and an elongate wooden body which encloses a writing-core, the body being inserted into a tubular plastics portion of the novelty device, the novelty device further comprising a plastics model adhered to an external surface of the tubular plastics portion.

2. A novelty pencil as claimed in claim 1, in which the tubular portion of the novelty device is fitted to an upper end of the body of the pencil, said end being reduced in diameter.

3. A novelty pencil as claimed in claim 1, in which the tubular portion of the novelty device is fitted as an interference fit to an upper end of the body of the pencil, said end being reduced in diameter.

4. A novelty pencil as claimed in claim 1, in which the external cross-sectional shape and size of the tubular portion of the novelty device corresponds with the external cross-sectional shape and size of the body of the pencil.

5. A novelty pencil as claimed in claim 1, in which the tubular portion of the novelty device is adhered to the reduced diameter portion of the body of the pencil.

6. A novelty pencil as claimed in claim 1, in which the tubular portion of the novelty device is open at one end for receiving the body of the pencil, its opposite end comprising an enlargement on which text or other decorative matter can be provided.

7. A novelty pencil as claimed in claim 6, in which the enlargement comprises a pair of faces which face in opposite directions radially of the pencil.

* * * * *